United States Patent [19]

Howlett

[11] 3,935,685

[45] Feb. 3, 1976

[54] ANCHOR MEMBER AND METHOD OF FORMING SAME

[75] Inventor: George H. Howlett, Oakland, Calif.

[73] Assignee: Howlett Machine Works, Berkeley, Calif.

[22] Filed: June 7, 1974

[21] Appl. No.: 477,371

[52] U.S. Cl. ..... 52/223 L; 29/507; 29/512

[51] Int. Cl.[2] .. E04C 3/10; E04C 3/26; B21D 39/00

[58] Field of Search ..... 52/223, 223 L; 24/126 C; 29/452, 507, 506, 505, 512, 520, 523

[56] References Cited

UNITED STATES PATENTS

| | | | |
|---|---|---|---|
| 850,299 | 4/1907 | Dickerson | 29/512 |
| 2,092,358 | 9/1937 | Robertson | 29/507 |
| 3,293,811 | 12/1966 | Rice | 52/223 L |
| 3,605,361 | 9/1971 | Howlett et al. | 52/223 L |
| 3,703,748 | 11/1972 | Kelly | 52/223 L |
| 3,762,027 | 10/1973 | Bertelson | 52/223 L |

FOREIGN PATENTS OR APPLICATIONS

| | | | |
|---|---|---|---|
| 940,578 | 10/1963 | United Kingdom | 29/512 |
| 37,202 | 4/1906 | France | 29/507 |

*Primary Examiner*—James L. Ridgill, Jr.
*Attorney, Agent, or Firm*—Warren, Chickering & Grunewald

[57] ABSTRACT

A method of forming an anchor member for use in a concrete prestressing anchorage is disclosed. The method includes the provision of plate means formed with a bore therethrough, positioning of a tubular conduit means in the bore, and urging of the conduit against the side walls of the bore to radially deform the conduit and bore into a tapered bore suitable for mounting of tendon gripping wedges therein. The urging step not only forms the taper in the bore, but also effects securement of the conduit to the plate. The conduit may be positioned to extend from either or both of the front or rear sides of the plate to provide or enable securement of auxiliary structures to the anchor member, e.g., means for mounting of the anchor member to a form board. The method employing the conduit may be used to effect securement of a plurality of plate-like elements together to form a unitized anchor plate. Anchor members including tubular conduit means press-fit into the tapered bore are also disclosed.

10 Claims, 11 Drawing Figures

ANCHOR MEMBER AND METHOD OF FORMING SAME

BACKGROUND OF THE INVENTION

The use of cables, bars, strands and other types of tendons to effect prestressing of concrete members is a common practice in the construction industry today. More particularly, post-tensioning of concrete slabs, walls and beams by means of such tendons has gained wide acceptance. Such post-tensioning commonly employs at least one and usually two tendon gripping anchorages formed to secure the reinforcing tendon and hold the same under extremely high axial loads.

Numerous types of concrete prestressing anchorages have been evolved with each having certain advantages, depending upon the application to which they are put. One type of anchorage which has gained particularly widespread use is the cast-in-place anchorage which is normally employed to secure a single reinforcing tendon. These cast-in-place tendons are commonly used in the construction of floor slabs and tilt-up walls, and usually a substantial quantity of tendon anchorages is required in the construction a building. Accordingly, a primary consideration in the selection of cast-in-place anchorages is the cost of the anchorage and the cost of its installation. Many of the cast-in-place single strand anchorages employed today are sold at a price of about $1.25 to $1.75, and a price difference of $0.10 can be determinative of which anchorage will be used.

As a result of this very competitive pricing, many of the most economical concrete prestressing anchorages are formed by casting, which eliminates the cost involved in more expensive fabricating processes, such as machining, notwithstanding the inherent loss in reliability and reproducibility which a casting process produces. Similarly, the cost in terms of apparatus for mounting the anchorage, usually in a recessed position to the form board, should be minimal. Accordingly, these anchorages have employed nails and simple plastic re-usable pipes together with rubber or wooden block-out members to effect mounting while keeping costs down.

Some typical examples of single strand concrete prestressing anchorages which have been employed for securement of reinforcing tendons are set forth in the following U.S. Pats: 3,293,811; 3,399,434; 3,408,783; 3,605,361; 3,676,031 and 3,685,934. While the anchorage and method of the present invention are particularly well suited for construction of a cast-in-place type of anchorage as set forth in the above-referenced patents, because of the inherent low cost, it will be understood that the concrete anchorage of the present invention may have numerous other applications, including multiple strand anchorages, non-recessed installations, etc.

Accordingly, it is an object of the present invention to provide a method for forming an anchor member for use in a concrete prestressing anchorage which may be used to produce a very low cost anchorage having the high strength and reliability of machined anchorages.

It is another object of the present invention to provide a method for forming an anchor member for use in concrete prestressing anchorages which provides greater flexibility in the construction of the anchor member to accommodate a wider variety of installation conditions.

It is still a further object of the present invention to provide a method for forming an anchor member for use in a concrete prestressing anchorage which can be employed to provide the necessary structure for a variety of different anchorage mounting techniques.

Another object of the present invention is to provide an anchor member which is relatively inexpensive to construct and yet has high strength and reliability.

The present invention has other objects and features of advantage which will become apparent from and are set forth in more detail in the following description of the preferred embodiments and the accompanying drawing.

DESCRIPTION OF THE PREFERRED EMBODIMENTS

Figure 1:
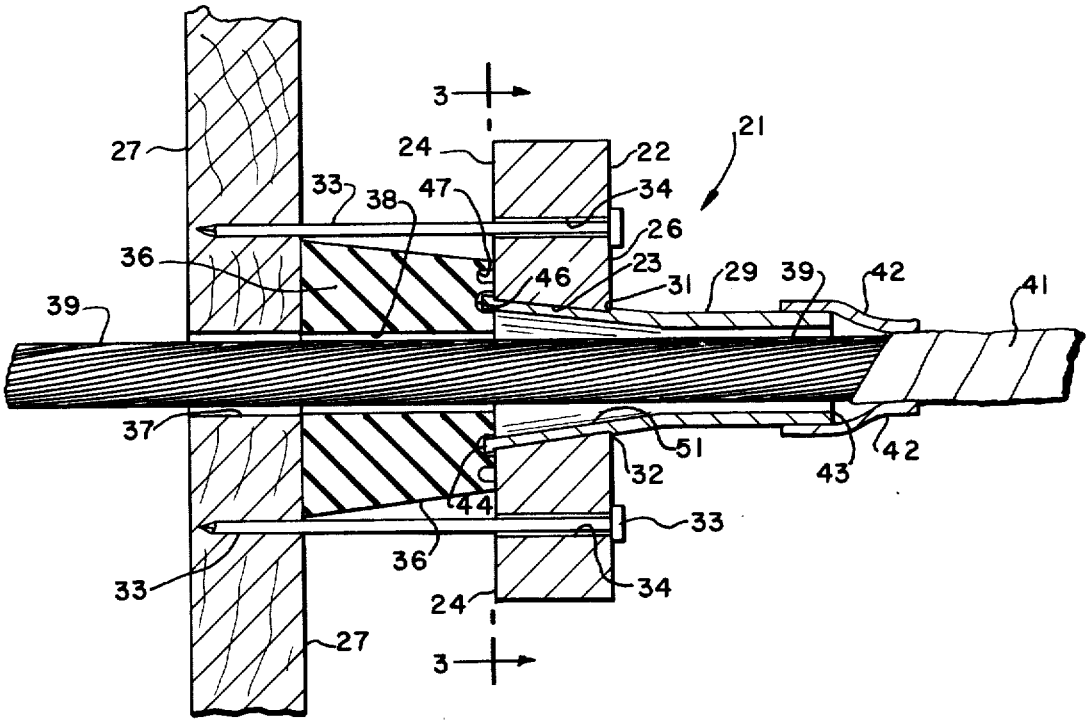
FIG. 1 is a fragmentary, top view, in cross-section, of a concrete prestressing anchorage before casting in the concrete member and showing an anchor member constructed in accordance with the present invention.

Referring now to FIGS. 1 through 4, the method of forming an anchor member of the present invention and the resulting anchor member can be described in detail. Anchor member 21 is composed of plate means 22 formed with a convergently tapered bore 23, which extends from a front side 24 of the plate means to a rear side 26. As used herein, the expression "front side" of the plate or plate means shall mean the side having the large diameter end of bore 23 formed proximate thereto, and the expression "rear side" shall mean the side of the plate having the small diameter end of bore 23 proximate thereto. Front side 24 of plate means 22 normally faces in the direction of form board 27 while rear side 26 normally faces toward the interior of concrete member 28.

The anchor member further includes convergently tapered tubular conduit means 29 mounted in bore 23 in mating relation therewith. The conduit means is secured in bore 23 against withdrawal from the large diameter end of the bore by interengaging shoulders 31 and 32 formed in the conduit and plate. In the form of the anchor member shown in FIGS. 1 and 2, conduit 29 extends outwardly of plate 22 from rear side 26 of the plate, and shoulder 32 is provided by the portion of plate 22 defining the opening of bore 23 at the rear side of the plate. Shoulder 31 is provided on conduit 29 by an annular ridge or step of greater diameter than the opening of bore 23 at the rear side of the plate. The manner of providing these interfitting shoulders, and particularly shoulder 31, will be described in more detail hereinafter. Thus, interengaging shoulders 31 and 32 prevent withdrawal of the conduit from the large diameter end of plate 22, and the taper of the bore and conduit prevents removal of the conduit from the small diameter end of the bore.

As shown in FIG. 1, the concrete prestressing anchorage has been mounted to form board 27 by means of fasteners 33 which extend through channels or bores 34 in plate 22. The fasteners in this case are conventional nails which may be driven into the form board. In order to recess the anchorage from the outside surface of concrete member 28, a rubber or wooden block-out member 36 is interposed between the form board and anchor plate. The form board and block-out member are formed with bores or channels 37 and 38, respectively, which are aligned with bore 23 in the anchor member and conduit 29 for passage of tendons 39 therethrough. The anchorage is shown in FIG. 1, therefore, in a condition suitable for pouring of concrete with tendon 39 in a relaxed or unstressed condition. The inner end of tendon 39 is normally covered by a plastic or paper covering 41 so that the tendon is not bound into the concrete and can be axially displaced to effect tensioning.

In order to prevent entry of concrete into the anchorage during casting a sealing means 42 in the form of a collar or grommet may be mounted on the end 43 of conduit means 29. Thus, the conduit means advantageously provides a structure which may be conveniently used to seal concrete from entry into the anchorage on the rear side of plate 22. Additionally, it is preferable for the conduit means 29 to extend from front side 24, as for example is provided by conduit portion 44. Conduit portion 44 cooperates with annular recess 46 in block-out member 36 to help seal against entry of concrete into the anchorage from the front side thereof. Additionally, a second annular recess 47 may be provided to ensure flexing of the block-out member in conformity to local surface irregularities in the front surface 24 of anchor plate 22.

With the anchor member installed as shown in FIG. 1, the concrete may be poured and the anchorage cast into the concrete member. Once the concrete is firm, form board 27 may be stripped from the concrete member and block-out member 36 may be removed to leave a frusto-conical cavity 48, which may be seen in FIG. 2, allowing access to the tapered bore of the anchor member. Tendon gripping wedges 49 may be inserted into conduit 29 and bear upon tapered inner surface 51 of the conduit, which surface cooperates in inducing convergent movement of the wedges to cause gripping of tendon 39. Tendon 39 is then axially distended or displaced to achieve the desired prestressing force by conventional jacking apparatus. The tendon gripping wedges will take up the axial load on the tendon and transfer the same to anchor plate 22 in a conventional fashion. After the tendon has been tensioned, the end sticking out beyond cavity 48 may be cut off, as can the ends of fasteners 33. In the usual installation, cavity 48 is then filled with grout (not shown) to provide a smooth surface on the edge of the concrete member. If desired, nails 33 can be bent inwardly toward cavity 48 before grouting to break away part of the thin concrete section and allow them to be cut off at a position interiorly of the outside surface of the concrete member.

Figure 4:
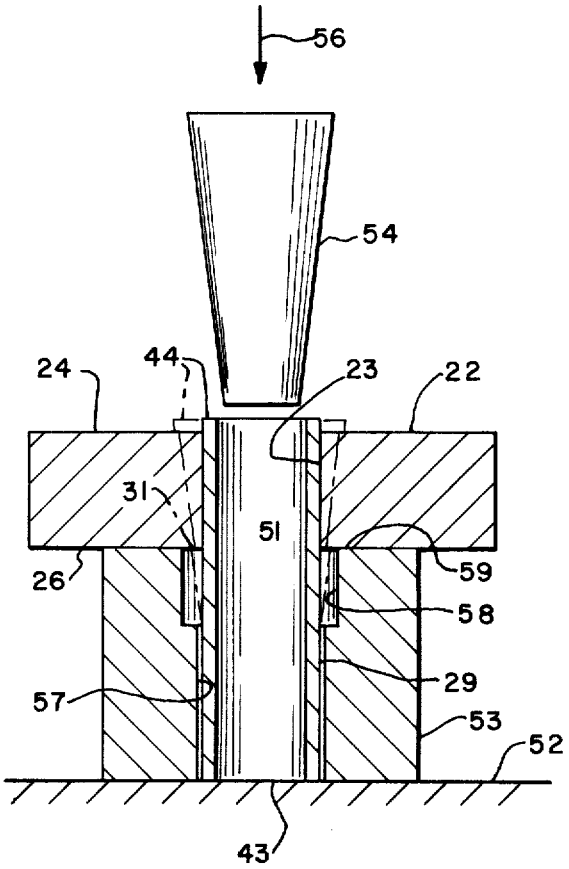
FIG. 4 is a side elevational view, in cross-section, schematically illustrating the method of the present invention.
Figure 3:
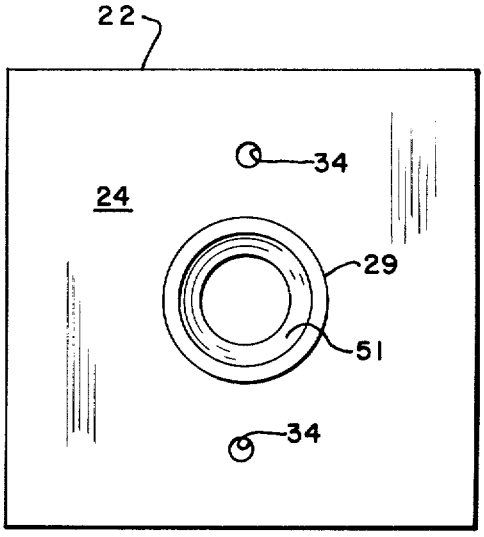
FIG. 3 is a front elevational view of the anchor member taken substantially along the plane of line 3 — 3 in FIG. 1.

The method of forming the anchor member of the present invention can best be understood by reference to FIG. 4, which illustrates the assembled components of the anchor member just prior to formation of the same. Plate means 22 is formed with central bore 23 therethrough, which bore has substantially parallel side walls. It is preferred that bore 23 be a cylindrical bore, although it may taper slightly in either direction, be polygonal in cross-section, or be somewhat irregular without effecting the method of the present invention. Most usually, it is preferred to form bore 23 by means of a punching operation since this can be accomplished rapidly and at a relatively modest cost. It is also possible, however, to drill or machine bore 23, depending upon the thickness of plate 22 and the material employed.

Tubular conduit 29 is positioned in bore 23, it being preferable that the bore 23 and the outside surface of conduit 29 be relatively dry and free of greases, dirt and the like. Bore 23 and conduit 29 are further preferably relatively dimensioned for sliding contact of the conduit with respect to the bore. The bore, however, can initially be substantially larger than the conduit and the fit therebetween relatively loose, as long as the bore is not so large that the conduit cannot be secured by or is destroyed by the radial deformation step.

In order to prevent relative axial displacement of the conduit and plate, end 43 of conduit 29 may rest on a supporting surface 52, while plate means 22 is held at the desired position with respect to conduit 29 by support chair 53.

Figure 2:
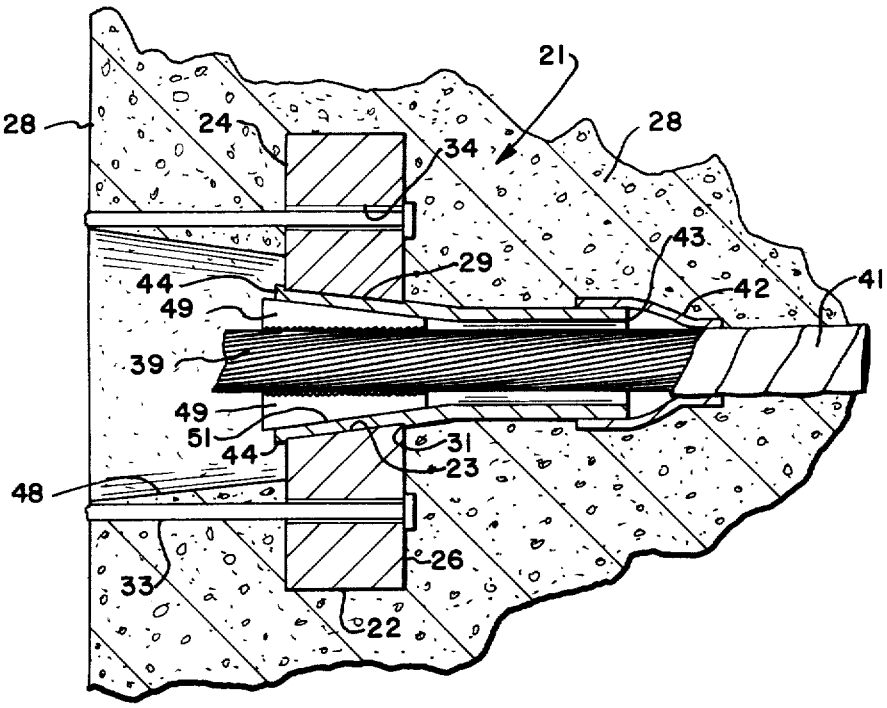
FIG. 2 is a fragmentary, top view, in cross-section, of the anchorage of FIG. 1 after casting of the concrete member.

The conduit 29 may now be urged against the side walls of bore 23 until the conduit and side walls are radially deformed into the tapered bore shown in FIGS. 1 and 2 and in phantom in FIG. 4. The urging step is preferably accomplished by cold forming through the use of a tapered mandrell 54 having a lubricated outer surface that is thrust downwardly into conduit 29 as indicated by arrow 56. The shape of mandrell 54 will determine the pitch of the tapered bore, which is preferably in the range of about 7° to 10°.

As mandrell 54 proceeds downwardly into conduit 53, the upper end 44 of the conduit is immediately outwardly deformed and transfers the lateral force to the plate adjacent the front side 24 thereof. The high radial force of the conduit against the plate causes the axial load on the conduit to be taken up or supported in large part by the frictional forces between the conduit and the plate bore 23 so that buckling of the conduit or pipe 29 between supporting surface 43 and mandrell 54 does not occur. Thus, chair 53 may be formed with an axial bore 57 which is larger than the conduit and provides a space therebetween. Chair 53 is, therefore, not required to support the conduit against buckling.

In order to accommodate outward displacement of the conduit at the small diameter end of the bore, a relieved section 58 in chair 53 is provided. The relieved section 58 of the bore of the chair preferably has a diameter only slightly greater than the eventual diameter of the conduit at rear side 26 of the plate, since the annular portion 59 of the chair defining relieved section 58 provides support for the plate against the tendency to roll or displace the plate downwardly.

Radial deformation of the conduit which is unsupported by the side walls of bore 23 results in greater lateral displacement than occurs in the areas engaged and supported by plate 22. In the form of the anchor member shown in FIGS. 1, 2 and 4, conduit 29 extends beyond both the front and rear surfaces of the plate means. Thus, the conduit is displaced outwardly to provide shoulder 31 at the small diameter end, which shoulder prevents withdrawal of the conduit from bore 23. A similar oppositely facing shoulder is formed at conduit portion 44, although this shoulder is not required to prevent withdrawal of the conduit from the plate. In order to assure the formation of a shoulder of adequate height for retention of the conduit in the plate bore, it is generally preferable that the conduit be formed of a material which has a lower yield strength than that of the plate.

It is possible to practice the method of the present invention and form the anchorage of the present invention by employing a bore 23 and conduit 29 which are initially dimensioned to be smaller than the tendon to be received through the bore. The urging step can be employed to increase the bore and conduit to a size which will accept the tendon. It is preferred, however, that the conduit and bore initially be dimensioned for receipt of the tendon since this allows the conduit to extend a substantial distance beyond the section of the conduit which is deformed to provide a structure to which sealing element 42 can be mounted.

As best may be seen in FIG. 2, tendon gripping wedges 49 have a length greater than the thickness of plate means 22, and conduit 29 includes a tapered section extending beyond the rear side of the plate means so as to mate with that portion of the wedges which extend beyond side 26 of the plate means. It is advantageous to minimize the thickness of plate means 22 so that the cost of the plate and formation of bore 23 is minimized, and wedges 49 can readily be cantilevered from the front and rear sides of the plate for a short distance without decreasing reliability. In fact, cantilevered support of the front end of the wedges will reduce the tendency of the wedges to bite-off or damage the tendon along the small diameter end of the wedges.

It should be noted that it is quite feasible to secure conduit 29 in bore 23 without having the conduit extend beyond the rear side 26 or the small diameter end of the bore. Conduit 29 may, for example, be formed of a material which is harder than plate 22. The conduit can further be formed with a ridge or protrusion at a position along the length of the conduit which will be positioned in the bore of the plate. Upon urging of the conduit radially, the protrusion will deform the plate and produce a mating recess. Thus, the protrusion and recess in the bore will provide interlocking shoulders which will prevent withdrawal of the conduit from the large diameter end of the bore. Similarly, a ring formed of a material which is harder than both the conduit and plate can be placed in the bore prior to cold forming. The conduit can be placed inside the ring, and the entire assembly may be radially deformed so that the ring deforms both the conduit and the plate to lock the assembly together. In both these approaches it would not be necessary, although it would be possible, for the conduit to extend beyond the rear side of the plate.

Figure 5:
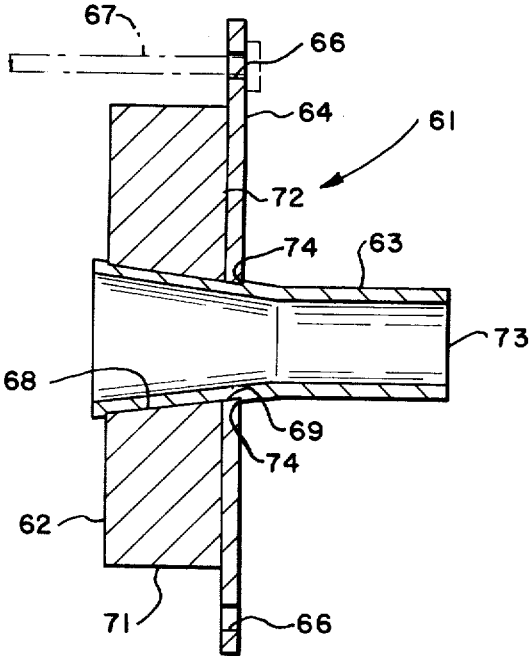
FIG. 5 is a top view, in cross-section, of an alternative embodiment of an anchor member constructed in accordance with the present invention.

The method and anchorage of the present invention can further be advantageously employed to effect securement of auxiliary structural members, such as anchorage mounting means, to the anchor member. Referring to FIG. 5, tendon anchor 61 can be seen to be comprised of plate means 62, conduit 63, and auxiliary structural member 64, in this case plate 64 provides anchorage mounting means. Anchor member 21 of FIGS. 1 through 4 was formed with openings 34 through plate 22. The formation of such openings through a relatively thick anchor plate can be undesirably expensive. In the anchorage of FIG. 5, the thick anchor plate 62 is formed with a central bore 68, but the mounting of the anchor member to a form board is accomplished by positioning fastener 67 through openings or channels 66 in the thin auxiliary member 64. Openings 66 as well as the central opening 69 in plate 64 can readily be formed by punching, a process much less expensive than machining. When fastener-receiving channels 66 are to be employed in the plate-like member 64, the member must extend laterally beyond edge 71 of the plate means so that the fastener may extend past the plate means to the form board.

The formation of anchor member 61 is substantially as above-described in connection with anchor member 21. Bore 68 is initially substantially cylindrical, as is conduit 63 and opening 69 in plate 64. Conduit 63 is assembled in bore 68 and auxiliary structural member 64 is mounted on the conduit proximate the rear side 72 of the plate. A chair (not shown) is used to support plate 62 and mounting member 64 while end 73 of the conduit is supported on a supporting surface. A lubricated tapered mandrell is then inserted into conduit 63 and urged downwardly until the tapered bore is formed. The urging step includes an outward radial urging of the conduit at a portion thereof beyond plate 64 so that a shoulder 74 is formed which locks the assembly together and prevents withdrawal of the conduit from bore 68. As used herein, therefore, the shoulder formed in the "plate means" of the anchorage shall include a shoulder as provided by mounting plate 64 immediately adjacent the plate means.

Figure 6:
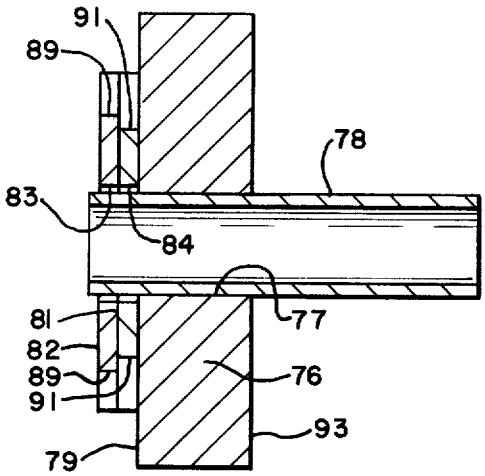
FIG. 6 is a top view, in cross-section, of still a further alternative embodiment of the anchor member of the present invention prior to formation of the tapered wedge receiving bore.
Figure 7:
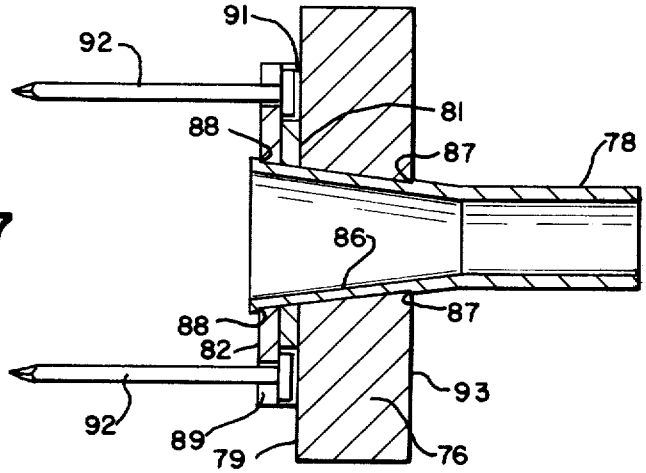
FIG. 7 is a top view, in cross-section, of the anchor member of FIG. 6 after formation of the tapered bore and with fasteners mounted thereto.
Figure 8:
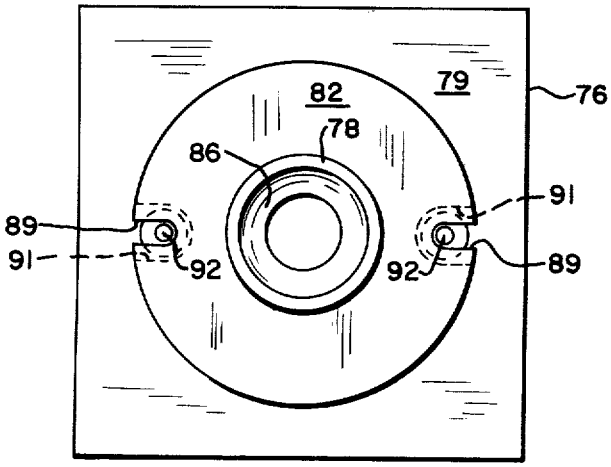
FIG. 8 is a front elevational view of the anchor member of FIG. 7.

FIGS. 6, 7 and 8 illustrate an anchorage formed by the method of the present invention in which auxiliary members are secured to the anchor plate assembly on the front side thereof. In FIG. 6 anchor plate 76 having cylindrical bore 77 is shown with conduit 78 extending therethrough. Mounted on front side 79 of the anchor plate are two washers 81 and 82. Washers 81 and 82 have aligned openings 83 and 84, which can be seen to be substantially larger than the outside diameter of conduit or pipe 78.

The assembly of FIG. 6 can be cold formed by pressing a tapered mandrell into conduit 78 to produce tapered section 86. The cold pressing step forms shoulder 87, which engages the rear side of plate 76 to lock the conduit against withdrawal, and further forms annular shoulder 88, which locks washer members 81 and 82 against the front side 79 of the plate. The advantage of providing washers with openings 83 and 84 of a substantially larger diameter than the initial diameter of conduit 78 is that the stress on the washers is minimized. The radial expansion at the large diameter end of the conduit is substantial, but washers 81 and 82 are not radially deformed until the conduit is expanded out to diameters 83 and 84.

The auxiliary washers 81 and 82 are employed to provide mounting means for the anchor member. Thus, fastener-receiving sockets are formed by a combination of U-shaped slot or opening 89 in washer 82, and the U-shaped slot 91 in washer 81. Slot 89 is dimensioned for sliding receipt of the shank of a nail 92, while slot 91 is dimensioned for sliding receipt of the head of nail 92. The front surface 79 of the plate provides a backing which completes the fastener receiving socket. An anchor member formed with this type of mounting means may be mounted to the form board by inserting nails 92 into the sockets and driving the nails into the form board with the block-out member and tendon in place by hammering on the rear side 93 of the anchor plate in the area behind the two sockets.

The method of the present invention can also be employed to form a unitized assembly from a plurality of separate washer elements to yield an anchor member having substantially the same strength as solid plate. Thus, as may be seen in FIG. 9, conduit 95 has been positioned through the central openings 96 of a plurality of separate washer elements 97. Upon radial deformation of the conduit to form tapered bore 98, oppositely facing annular shoulders 99 and 101 are formed and engage the frontmost and rearmost washers 97 to hold the assembly against relative axial displacement or separation.

Thus, positioning the conduit so that it extends through each opening of the washer elements 97 allows the formation of the washer elements with the method of the present invention into an anchor plate of substantial strength. This is most important since it allows the anchor plate to be formed of relatively thin washers which can be readily punched, and the washers can often be formed from what would otherwise be scrap material.

Figure 9:
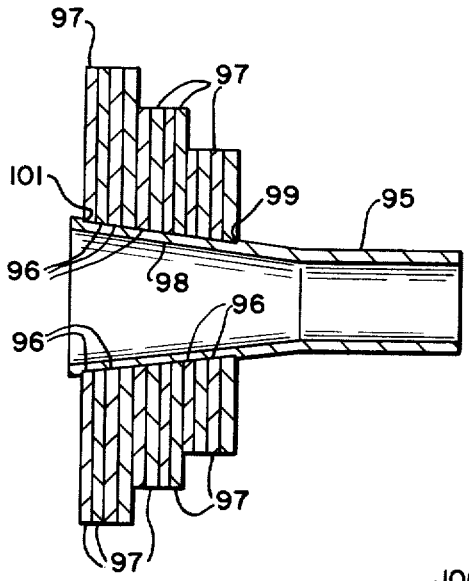
FIG. 9 is a top view, in cross-section, of a further alternative embodiment of an anchor member constructed in accordance with the present invention.

Additionally, the washers can be assembled to have various profiles as, for example, is provided by the gradiated peripheries to provide steps in the anchor member of FIG. 9. Still further, the diameters of the central openings of the washers can be selected so that they increase from the small diameter end of the tapered bore to the larger diameter end so that the stress on each washer is approximately equal. The diameters of the central openings 96 of the washers should be less than the outside diameter of the conduit after the urging or radial deformation step. It is possible, however, that only the frontmost and rearmost washers have a diameter less than the outside diameter of the conduit because the intermediate washers are locked in place, but it is preferable that the intermediate washers support the tapered bore over the length of the anchor member.

Figure 10:
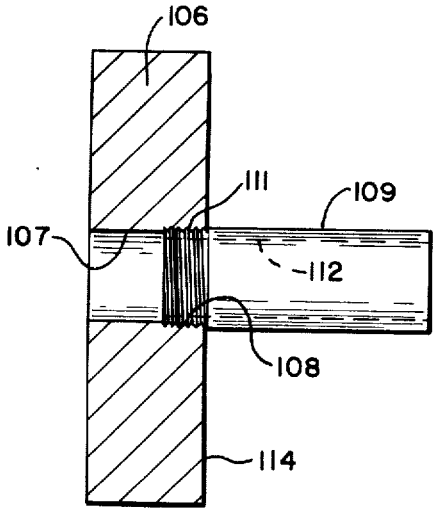
FIG. 10 is a top view, in cross-section, of still a further alternative embodiment of an anchor member constructed in accordance with the present invention prior to formation of the tapered wedge receiving bore.
Figure 11:
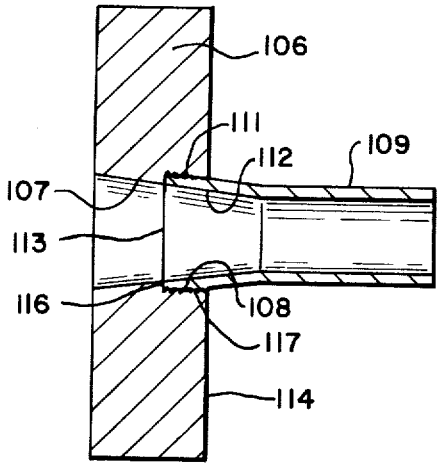
FIG. 11 is a top view, in cross-section, of the anchor member of FIG. 10 after formation of the wedge receiving bore.

The anchor member of the present invention can also be formed with the conduit means inserted into the plate means a distance less than the length of the bore, as best may be seen in FIGS. 10 and 11. Plate means 106 is formed with a cylindrical bore 107 having threads 108 formed in what will be the same diameter end of bore 107. Mounted to extend into bore 107 a distance less than the length of the bore is conduit 109. Conduit 109 is formed with threads 111 which are adapted for mating threaded engagement with threads 108 in the bore of the anchor plate. Mating threads 108 and 111 provide means for securement of the conduit against displacement of the bore during the forming step, and it will be understood that a mating groove and recess, as for example may be provided by a bayonet connection, can also be employed to retain the conduit in bore 107. As will be seen in FIG. 10, the interior diameter 112 of conduit or pipe 109 presents a step or discontinuity at the end of the pipe that is located in bore 107. During the formation of the anchorage, however, the inner surface 112 of conduit 109 is radially displaced to provide a relatively smooth juncture or interface 113 between the conduit and bore 107, as best may be seen in FIG. 11. Thus, the discontinuity between the bore and the end of the conduit is eliminated and a substantially continuous tapered bore surface results.

In this anchorage, there is no need for a shoulder on the rear side 114 of plate 106 since shoulder 116 will prevent ejection of the conduit from the large diameter end of the bore. Annular corner 117 at the small diameter end of the bore resists pulling of the conduit out from the small diameter end, together with the interfitting, although deformed, threads 108 and 111.

The materials employed in the method of the present invention and for formation of the anchor of the present invention can vary in accordance with the loads which the anchorage must secure. Some typical values for the securement of ½ inch nominal diameter strand or cable would include a 3 × 3½ inch C1040 steel plate having a thickness of approximately ¾ inch and a yield strength of about 50,000 to 60,000 p.s.i. The conduit may be provided by a malleable steel pipe, preferably seamless tubing, such as a water pipe. The conduit before the deforming step has an outside diameter of about 0.850 inches and an inside diameter of about 0.60 inches. The diameter of the bore in the plate before forming is about 0.90 inches. The conduit may have an overall length of about 2½ inches and extends outwardly of the bore on the front side of the plate approximately ⅛ to 3/16 of an inch. During the forming step, the tapered bore is preferably formed to between 7° and 10° pitch, although greater or lesser tapers can be provided if desired. The wedges which are placed in the bore may have a length of about 1⅜ to 1⅝ inches so that they are cantilevered approximately ¼ inch from both the front and rear sides of the plate.

In another suitable form for anchoring a one-half inch strand, a 1-inch thick A36 steel anchor plate having a yield strength in the range of 36,000 to 46,000 p.s.i. is employed. The conduit again can be formed from malleable seamless water pipe which has a yield strength of about 20,000 to 40,000 p.s.i. When the anchor plate is formed from a plurality of washers, the washers can be C1040, A36 or any one of a number of conventionally available mild steels.

The forming mandrell for use in the method of the present invention is preferably formed of a high strength, relatively hard tool steel that may be chrome-plated, if desired, to reduce sticking. The mandrell has a Rockwell C hardness of 60 or more. When forming the anchor member from a ¾ inch C1040 steel plate, approximately 50,000–60,000 pounds of axial force is required to effect deformation of the tapered bore, and approximately the same range of forces is required when the thicker but softer one-inch thick A36 plate is employed. The mandrell can be lubricated for a cold forming by wiping a lightweight grease or lubricant over the surface of the same.

What is claimed is:

1. A method of forming an anchor member for use in a concrete prestressing anchorage comprising:

a. providing plate means formed with a bore therethrough defined by substantially parallel side walls;

b. positioning tubular conduit means into said bore; and c. permanently radially deforming said conduit means and said substantially parallel side walls of said plate means beyond the elastic limits thereof and during said deforming step further deforming the combination of said conduit means and said substantially parallel side walls of said plate means from parallel walls to frustoconical tapered walls defining a bore dimensioned for receipt of a tendon and tendon gripping wedges therein, and effecting securement of said conduit means to said plate means during said deforming step.

2. A method of forming an anchor member as defined in claim 1 wherein, during said positioning step, said conduit means is positioned in said bore less than the overall depth of said bore, and said deforming step is accomplished to a degree causing the discontinuity between said bore and the end of said conduit means to be formed into a substantially continuous tapered bore surface.

3. A method of forming an anchor member as defined in claim 1 wherein, said conduit means is positioned in said bore with a portion of said conduit means extending outwardly of said plate means on a front side of said plate means; and the step of:

mounting a member having an opening therein dimensioned to receive said conduit means onto said portion of said conduit means proximate said plate means on said front side of said plate means prior to said deforming step; and permanently deforming said portion of said conduit means radially outwardly until said member is secured to said conduit means proximate said plate means.

4. A method of forming an anchor member as defined in claim 1 wherein, said plate means is provided by a plurality of separate washer elements each having a central opening therethrough, and the steps of:

positioning each opening in said washer elements in substantial axial alignment before said first named positioning step;

positioning said conduit means to extend into all of the openings in said washer elements to ensure engagement of each washer element by said conduit means during said deforming step; and permanently deforming said conduit means radially outwardly beyond the elastic limit thereof while supporting said washer elements and conduit means against relative axial displacement, and forming said tapered bore and securing each of said washer elements to said conduit means and form a unitized assembly during said deforming step.

5. A method of forming an anchor member as defined in claim 4 and the step of, selecting at least one of said washer elements adjacent the end of said conduit means to undergo the greatest radial deformation to have an opening prior to deformation of greater diameter than the openings of the remainder of said washer elements and less than the outside diameter of said conduit means after said urging step.

6. A method of forming an anchor member as defined in claim 1 and, the step of positioning said conduit means in said bore prior to said deforming step with a portion of said conduit means extending outwardly of said plate means on a rear side of said plate means.

7. A method of forming an anchor member as defined in claim 6 wherein, said plate means is formed of a thickness less than the length of a tendon gripping means to be placed in said anchor member, and said deforming step is accomplished to form a tapered bore in said conduit means having a tapered section extending beyond said rear side of said plate means.

8. A method of forming an anchor member as defined in claim 6 and the steps of:

mounting an auxiliary structural member having an opening therein dimensioned to receive said conduit means onto said portion of said conduit means proximate said plate means prior to said urging step; and said deforming step is accomplished to permanently deform said portion of said conduit means beyond the elastic limit thereof radially outwardly until said member is secured to said conduit means proximate said plate means.

9. In an anchor member for use in forming a prestressed concrete anchorage including plate means formed with a convergently tapered bore extending from a front side of said plate means having the large diameter end of said bore formed therein to a rear side of said plate means the improvement comprising:

said plate means being provided by a plurality of independent abutting plates each having an opening, the openings in said plates being axially aligned and gradually decreasing in size from said front side of said plate means to said rear side of said plate means to provide said bore, and a convergently tapered tubular conduit mounted in said bore in mating relation therewith, said conduit being mounted in said bore in interference fit with said plates to secure said plates in a unitized assembly.

10. In an anchor member for use in forming a prestressed concrete anchorage including plate means formed with a convergently tapered bore extending from a front side of said plate means having the large diameter end of said bore formed therein to a rear side of said plate means the improvement comprising:

a convergently tapered tubular conduit mounted in said bore in mating relation therewith;

said conduit includes a portion extending outwardly of said bore beyond at least one of said front side and said rear side of said plate means; and anchorage mounting means secured to said conduit and formed as a plate-like member mounted to said portion of said conduit means by a channel passing through said member, said member extending laterally of said conduit to a position beyond said plate means and said member being formed with fastener securement means adapted for securement of at least one fastener to said member outwardly of said plate means for mounting of said anchor member to said form board.

* * * * *

UNITED STATES PATENT OFFICE

CERTIFICATE OF CORRECTION

PATENT NO. : 3,935,685

DATED : February 3, 1976

INVENTOR(S) : George H. Howlett

It is certified that error appears in the above-identified patent and that said Letters Patent are hereby corrected as shown below:

Claim 5, line 9 (Column 10, line 2), delete "urging" and insert therefor ---deforming---;

Claim 8, line 6 (Column 10, line 22), delete "urging" and insert therefor ---deforming---; and Column 7, line 63, delete "same" and insert therefor ---small---.

Signed and Sealed this

Sixteenth Day of November 1976

[SEAL]

*Attest:*

RUTH C. MASON
*Attesting Officer*

C. MARSHALL DANN
*Commissioner of Patents and Trademarks*